US011733002B2

(12) United States Patent
Rosen et al.

(10) Patent No.: US 11,733,002 B2
(45) Date of Patent: Aug. 22, 2023

(54) MOUNTING SYSTEM FOR MINI RED DOT SIGHTS

(71) Applicant: Sheltered Wings, Inc., Barneveld, WI (US)

(72) Inventors: Michael Rosen, Barneveld, WI (US); Seth Toy, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

(21) Appl. No.: 17/387,356

(22) Filed: Jul. 28, 2021

(65) Prior Publication Data

US 2022/0034631 A1 Feb. 3, 2022

Related U.S. Application Data

(60) Provisional application No. 63/057,377, filed on Jul. 28, 2020.

(51) Int. Cl.
*F41G 11/00* (2006.01)
*F41G 1/30* (2006.01)

(52) U.S. Cl.
CPC ..... *F41G 11/003* (2013.01); *F41G 1/30* (2013.01)

(58) Field of Classification Search
CPC ..... F41G 11/003; F41G 1/30
See application file for complete search history.

(56) References Cited

U.S. PATENT DOCUMENTS 1,002,115 A * 8/1911 Barnes ..... F41C 27/18 42/86
2,528,080 A * 10/1950 Robertson ..... F41G 11/003 42/127
2,545,419 A * 3/1951 Williams ..... F41G 11/006 248/316.1
2,597,565 A * 5/1952 Gordon ..... F41C 23/16 362/110
2,873,902 A * 2/1959 Decker ..... F41C 33/007 224/257
3,488,488 A * 1/1970 Crouch ..... F41G 1/35 42/71.01
4,383,371 A * 5/1983 Coffey ..... F41G 11/003 42/126

(Continued)

OTHER PUBLICATIONS

International Search Report and Written Opinon for International Application No. PCT/US2021/043473 dated Nov. 4, 2021.

(Continued)

*Primary Examiner* — Michelle Clement
(74) *Attorney, Agent, or Firm* — Husch Blackwell LLP

(57) ABSTRACT

A mounting system for securing a viewing optic to a firearm utilizes an oblong dovetail connection component having a first end, a second end, and a contoured perimeter forming a dovetail profile. The viewing optic has a bottom surface comprising a mortise slot open at a first end to receive the oblong dovetail connection component and closed at a second end, the viewing optic further comprising a fastening area on a side of the viewing optic, the fastening area having a first securing structure. A fastening element having a second securing structure, wherein the first and second securing structures correspond to one another and facilitate securing the fastening element to the fastening area.

15 Claims, 4 Drawing Sheets

(56) References Cited

U.S. PATENT DOCUMENTS 4,494,328 A * 1/1985 Stevens ..... F41C 27/00 42/115
4,571,870 A * 2/1986 Heideman ..... F41G 11/001 42/114
4,899,479 A * 2/1990 Sanders ..... F41G 1/16 42/112
4,929,973 A * 5/1990 Nakatani ..... F16M 11/041 396/419
5,014,892 A * 5/1991 Copeland ..... A45F 5/021 224/678
5,054,170 A * 10/1991 Otrusina ..... A45F 5/021 24/669
5,531,039 A * 7/1996 Gore ..... F41G 11/002 42/124
5,758,448 A * 6/1998 Thummel ..... F41G 1/36 42/114
5,816,683 A * 10/1998 Christiansen ..... F41C 27/00 362/110
6,115,952 A * 9/2000 Rigler ..... F41C 27/00 362/110
6,371,424 B1 * 4/2002 Shaw ..... F41G 1/54 248/222.12
6,629,381 B1 * 10/2003 Keng ..... F41G 11/003 42/124
7,493,722 B2 * 2/2009 Howe ..... F41G 11/003 362/110
7,811,024 B2 * 10/2010 Vendetti ..... F41G 11/003 403/381
7,866,083 B2 * 1/2011 Teetzel ..... F41G 1/35 42/117
8,020,335 B2 * 9/2011 Larsson ..... F41C 27/00 42/127
8,166,694 B2 * 5/2012 Swan ..... F41C 33/007 224/198
8,220,946 B1 * 7/2012 Teetzel ..... F41G 11/003 89/200
8,424,234 B2 * 4/2013 Carlson ..... F41G 11/001 42/90
8,448,366 B2 * 5/2013 Faifer ..... F41G 11/003 42/72
8,943,730 B2 * 2/2015 Ascano ..... F41C 33/007 42/94
9,121,544 B2 * 9/2015 DiCarlo ..... F16M 11/041
9,243,870 B2 * 1/2016 Teetzel ..... G02B 23/125
9,423,216 B2 * 8/2016 Cheng ..... F41C 23/16
9,546,848 B1 * 1/2017 Burger, Sr. ..... F41G 11/003
9,568,282 B1 * 2/2017 Schorman ..... G03B 17/561
9,599,437 B2 * 3/2017 Eble ..... F41G 11/003
9,677,854 B1 * 6/2017 Tran ..... F41G 11/003
9,958,667 B2 * 5/2018 DiCarlo ..... G02B 23/16
9,966,204 B2 * 5/2018 McCauley ..... F41G 11/003
10,101,126 B2 * 10/2018 Sharron ..... F41G 11/003
10,222,172 B2 * 3/2019 Melville ..... F41C 33/041
10,260,841 B2 * 4/2019 Kincel ..... F41C 27/00
10,317,163 B2 * 6/2019 Poindexter ..... F41A 23/02
10,317,173 B2 * 6/2019 DiCarlo ..... F41G 11/003
10,563,956 B2 * 2/2020 Kowalczyk, Jr. ..... F41G 1/35
10,670,374 B2 * 6/2020 Storch ..... F41C 27/00
10,697,623 B2 * 6/2020 Worman ..... F21V 7/0075
10,718,592 B1 * 7/2020 Wheeler ..... F41G 1/17
10,753,710 B2 * 8/2020 Niswander ..... F41G 11/003
10,816,309 B2 * 10/2020 Martindale ..... F41A 5/24
10,876,815 B1 * 12/2020 Wingfield ..... F41G 1/16
10,948,267 B2 * 3/2021 Zimmer ..... F41G 11/002
11,029,131 B2 * 6/2021 Cahill ..... F41G 11/003
11,047,644 B2 * 6/2021 Shearer ..... F41C 33/0263
11,067,365 B2 * 7/2021 Roberson ..... F41G 1/16
11,092,403 B2 * 8/2021 Ray ..... F41C 23/20
11,105,586 B2 * 8/2021 Tayon ..... F41G 11/003
11,125,536 B2 * 9/2021 Kowalczyk, Jr. ..... F41G 11/003
11,150,046 B2 * 10/2021 Keller ..... F41A 23/10
11,193,735 B2 * 12/2021 Ma ..... F41G 11/003
11,300,382 B2 * 4/2022 Holly ..... F41G 1/46
11,304,503 B2 * 4/2022 Blumenthal ..... A45F 5/021
11,320,244 B2 * 5/2022 Verjovsky ..... F41G 11/003
2003/0141329 A1 * 7/2003 Huang ..... A45F 5/02 224/269
2008/0307689 A1 * 12/2008 Dotson ..... F41A 23/06 42/94
2010/0011647 A1 * 1/2010 Faifer ..... F41G 11/003 42/90
2010/0077646 A1 * 4/2010 Gaber ..... F41G 1/467 42/129
2010/0154279 A1 * 6/2010 Polyzos ..... F41G 1/35 42/117
2011/0032694 A1 * 2/2011 Swan ..... F41C 23/16 362/157
2011/0146128 A1 6/2011 Haering
2013/0219767 A1 8/2013 Peterson et al.
2013/0276343 A1 * 10/2013 Peters ..... F41C 33/006 29/469
2016/0334193 A1 * 11/2016 Zimmer ..... F41G 11/001
2017/0059277 A1 3/2017 Justice
2017/0299337 A1 * 10/2017 Ding ..... F41G 11/004
2018/0073840 A1 * 3/2018 Kristoffersen ..... F41G 1/545
2018/0195835 A1 7/2018 Crispin et al.
2018/0195838 A1 * 7/2018 Storch ..... F41G 11/001
2019/0056195 A1 * 2/2019 Melville ..... F41C 33/006
2020/0386522 A1 * 12/2020 Duncan, III ..... F41G 11/004
2021/0140740 A1 * 5/2021 Noonan ..... F41G 1/18
2021/0199409 A1 * 7/2021 Zimmer ..... F41G 11/002
2021/0270572 A1 * 9/2021 Dawson, Jr. ..... F41G 11/001
2021/0325146 A1 * 10/2021 Thomele ..... F41A 9/53
2021/0372739 A1 * 12/2021 Nielsen ..... F41G 11/003
2022/0268553 A1 * 8/2022 Roth ..... F41G 11/001

OTHER PUBLICATIONS

International Preliminary Report on Patentability issued by International Application No. PCT/US2021/043473 dated Jan. 31, 2023, 6 pages.

* cited by examiner

MOUNTING SYSTEM FOR MINI RED DOT SIGHTS

CROSS-REFERENCE TO RELATED APPLICATIONS

This application is a non-provisional application of and claims priority to U.S. Provisional Patent Application No. 63/057,377 filed Jul. 28, 2020, which is incorporated herein by reference in its entirety.

FIELD

The disclosure relates to a mounting system for viewing optics. In one embodiment, the disclosure relates to a mounting system for mounting a mini red dot sight to a firearm.

BACKGROUND

Mini red dot sights (MRDSs) are non-magnifying reflector sights generally used with small firearms such as handguns and pistols. MRDSs use a reflective optical system to project light toward the user to see the target field and the illuminated red dot reticle. MRDSs can be either enclosed, in which all of the optical elements are completely encased by a housing, or open, in which at least a portion of the optical elements are not encased by a housing.

Open MRDSs are smaller and generally easier to mount to firearms, as screws or other mounting hardware can project through the exposed upper surface of the base and directly tie into securing structures on the upper surface of the firearm. Because the optical elements are exposed, however, open MRDSs do collect dirt/debris which can effect the performance of the MRDS.

Closed MRDSs have a full housing, so the optical elements are protected and not exposed to the elements. However, as a result of being fully enclosed, the upper surface of the base is not exposed, and closed MRDSs are therefore not so easily connected to a firearm. Closed MRDSs are generally secured to a firearm by their sides, which requires compatible securing structures on both the firearm and the MRDS.

Current enclosed MRDSs each use a unique and proprietary mounting solution based on the MRDS make and the make and model of the firearm to which it is being secured. For example, most enclosed MRDSs require a proprietary mounting plate to make the mounting structures of the MRDS compatible with the mounting structures. In other words, a different proprietary mounting plate is required for each different make and model of firearm. Moreover, this mounting plate is generally only useful when securing closed MRDSs to a firearm and must be removed to use an open MRDS.

Alternatively, some MRDSs have a removable/detachable casing, allowing the MRDS to be used and connected to a firearm as an open MRDS. The casing can then be reattached if the user desires to utilize the MRDS as a closed MRDS. It will be appreciated that having a removable/detachable casing still exposes the optical elements to the environment, even if the MRDS is ultimately used as a closed MRDS.

For the reasons discussed above, having a mounting system useful with open and closed MRDSs, and/or compatible with any make and model of firearm, is a big advantage. Thus, there is a large need for a mounting system that can address these concerns.

SUMMARY

In one embodiment, the disclosure provides a mounting system for securing a viewing optic to a firearm. In accordance with embodiments of the disclosure, a mounting system for securing a viewing optic to a firearm, the mounting system comprises an oblong dovetail connection component having a first end, a second end, and a contoured perimeter forming a dovetail profile; a viewing optic having a bottom surface comprising a mortise slot open at a first end to receive the oblong dovetail connection component and closed at a second end, the viewing optic further comprising a fastening area on a side of the viewing optic, the fastening area having a first fastening structure; and a fastening element having a second securing structure, wherein the first and second securing structures correspond to one another and facilitate securing the fastening element to the fastening area.

In a further embodiment, the fastening area is a countered groove having a depth and the fastening element having a thickness approximately equal to the depth of the contoured groove. In another embodiment, the first end of the oblong dovetail connection component is rounded. In yet another embodiment, the first and second securing structures each comprise at least one screw hole, wherein the respective at least one screw holes of the fastening area and the fastening element are coaxial. In a further embodiment, the viewing optic is a MRDS. In yet another embodiment, the MRDS is a closed MRDS.

In another embodiment, the disclosure provides a firearm. In accordance with embodiments of the present disclosure, a firearm comprises at least one accessory mounting structure comprising a pair of threaded openings; a dovetail connection component having a first end, a second end, a contoured perimeter forming a dovetail profile, and at least two screw holes, wherein the dovetail connection component is positioned on the firearm such that the at least two screw holes are coaxial with the threaded openings and secured to the firearm using at least two screws; a viewing optic having a bottom surface comprising a mortise slot open at a first end to receive the oblong dovetail connection component and closed at a second end, the viewing optic further comprising a fastening area on a side of the viewing optic, the fastening area having a first securing structure, wherein the viewing optic is slidingly engaged with the dovetail connection component; and a fastening element having a second securing structure, wherein the first and second securing structures correspond to one another and facilitate securing the fastening element to the fastening area.

In a further embodiment, the at least two screw holes of the dovetail connection component are countersunk. In a still further embodiment, the fastening area is a contoured groove having a depth and the fastening element has a thickness approximately equal to the depth of the contoured groove. In a further embodiment, the first end of the oblong dovetail connection component is rounded. In yet another embodiment, the first and second securing structure each comprise at least one screw hole, wherein the respective at least one screw holes of the fastening area and the fastening element are coaxial. In another embodiment, at least one screw engages the first and second securing structures. In another embodiment, the firearm is selected from a handgun and a pistol. In a further embodiment, the viewing optic is a MRDS, and further still a closed MRDS.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

Figure 1:
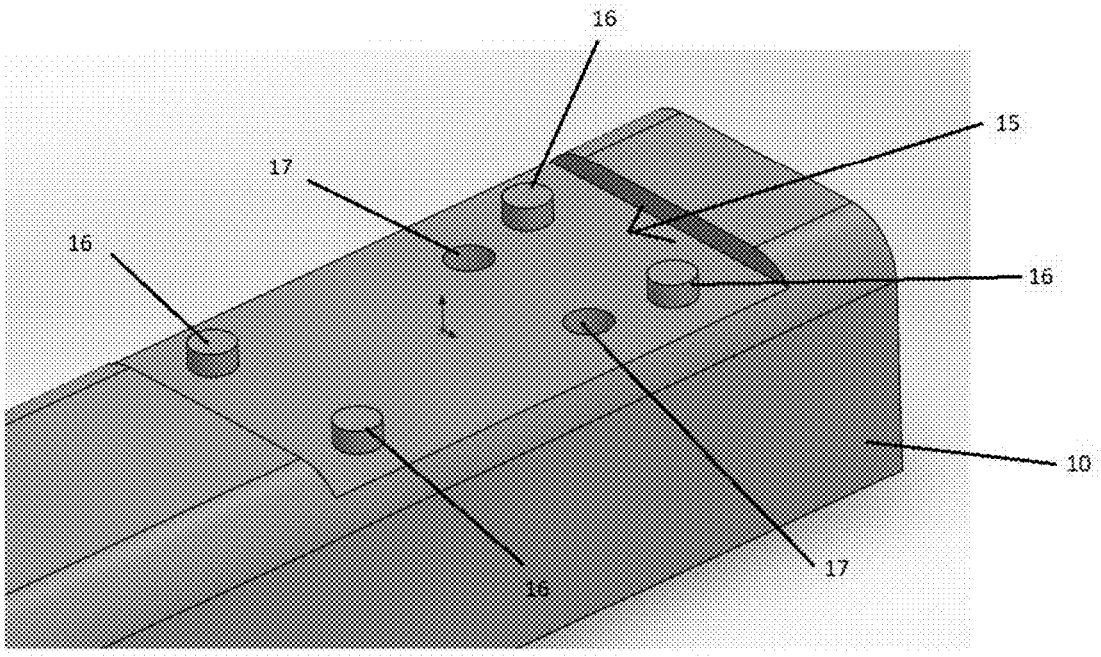
FIG. 1 illustrates an exemplary accessory mounting structure of a firearm.

Before explaining embodiments of the disclosure in detail, it is to be understood that the disclosure is not limited in its application to the details of construction and the arrangement of the components set forth in the following description or illustrated in the drawings. The technology of this present disclosure is capable of other embodiments or being practiced or carried out in various ways. Also, it is to be understood that the phraseology and terminology employed herein is for the purpose of description and should not be regarded as limiting.

DETAILED DESCRIPTION

The apparatuses and methods disclosed herein will now be described more fully hereinafter with reference to the accompanying drawings, in which embodiments of the disclosure are shown. The apparatuses and methods disclosed herein may, however, be embodied in many different forms and should not be construed as limited to the embodiments set forth herein. Rather, these embodiments are provided so that the disclosure will be thorough and complete and will fully convey the scope of the invention to those skilled in the art.

It will be appreciated by those skilled in the art that the set of features and/or capabilities may be readily adapted within the context of a standalone viewing optic, such as a weapons sight, front-mount or rear-mount clip-on weapons sight, and other permutations of field deployed optical weapons sights. Further, it will be appreciated by those skilled in the art that various combinations of features and capabilities may be incorporated into add-on modules for retrofitting existing fixed or variable viewing optics of any variety.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, melt index, temperature, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, relative amounts of components in a mixture, and various temperature and other parameter ranges recited in the methods.

Spatial terms, such as "beneath," "below," "lower," "above," "upper," and the like, may be used herein for ease of description to describe one element's or feature's relationship to another element(s) or feature(s) as illustrated in the figures. It will be understood that the spatially relative terms are intended to encompass different orientations of device in use or operation in addition to the orientation depicted in the figures. For example, if the device is turned over, elements described as "below" or "beneath" other elements or features would then be orientated "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the term "and/or" includes any and all combinations of one or more of the associated listed terms. For example, when used in a phrase such as "A and/or B," the phrase "and/or" is intended to include both A and B; A or B; A (alone); and B (alone). Likewise, the term "and/or" as used in a phrase such as "A, B and/or C" is intended to encompass each of the following embodiments: A, B and C; A, B, or C; A or C; A or B; B or C; A and C; A and B; B and C; A (alone); B (alone); and C (alone).

It will be understood that when an element or layer is referred to as being "on," "connected to," or "coupled to" another element or layer, it can be directly on, connected to or coupled to the other element or layer. Alternatively, intervening elements or layers may be present. In contrast, when an element or layer is referred to as being "directly on," "directly connected to," or "directly coupled to" another element or layer, there are no intervening elements or layers present.

As used herein, a "firearm" is a portable gun, being a barreled weapon that launches one or more projectiles often driven by the action of an explosive force. As used herein, the term "firearm" includes a handgun, a long gun, a rifle, a shotgun, a carbine, automatic weapons, semi-automatic weapons, a machine gun, a sub-machine gun, an automatic rifle and an assault rifle.

FIG. 1 illustrates a portion of an exemplary firearm 10, such as a handgun or pistol, including the accessory mounting structures 15. In the particular embodiment shown, the accessory mounting structures 15 include a plurality of protuberances 16 and at least two threaded openings 17. In the particular embodiment shown, the protuberances 16 assist in aligning an accessory on the firearm 10, and the threaded openings 17 engage screws, such as, for example, when securing a standard open MRDS. It will be appreciated that this is but one example of accessory mounting structures which may be used on a firearm. Other makes and models of firearms may have different types of securing structures and/or different arrangements of securing structures. One commonality among accessory mounting structures, however, is the presence of threaded openings 17.

Figure 2:
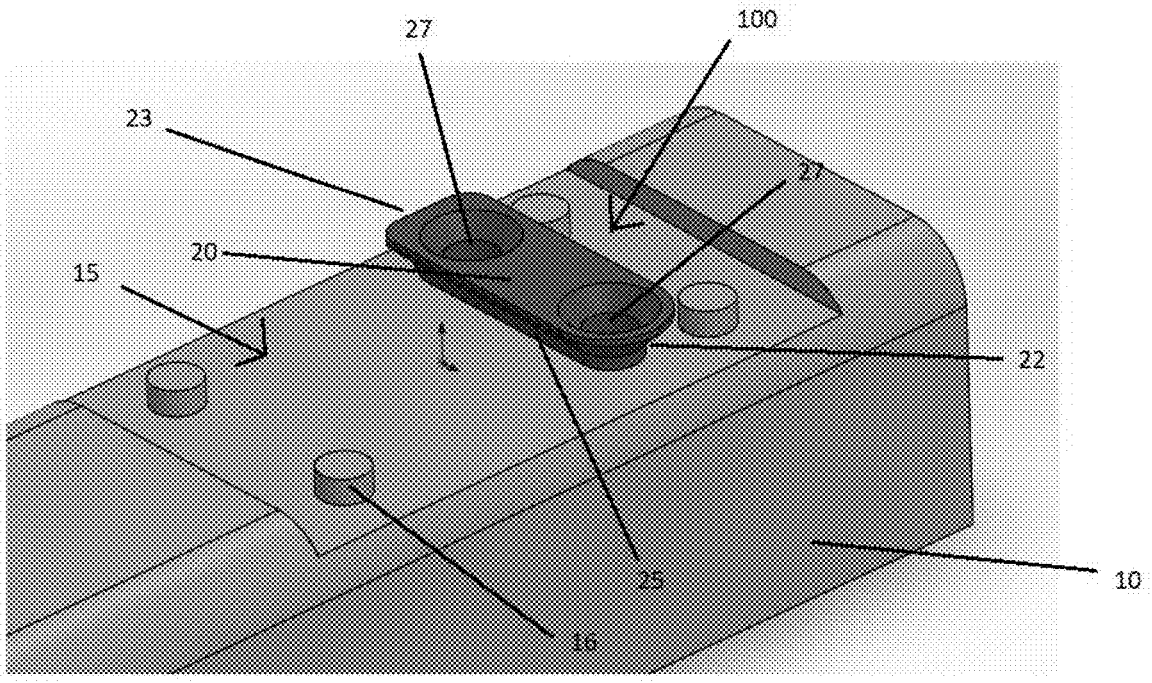
FIG. 2 illustrates an exemplary dovetail connection component in accordance with embodiments of the present disclosure.

FIG. 2 shows an exemplary dovetail connection component 100 in accordance with embodiments of the present disclosure. The dovetail connection component 100 is generally oblong having a smooth upper surface 20, a first end 22 and a second end 23. The perimeter 25 of the dovetail connection component 100 is contoured at an angle, such that the upper surface 20 is wider than the surface contacting the firearm 10, thus creating a so-called "dovetail" profile.

In the particular embodiment shown, the first end 22 is a rounded end and the second end 23 is a flattened end. As will be shown with respect to FIG. 3, the rounded nature of the first end 22 facilitates the alignment of the closed MRDS 200 when sliding onto the dovetail connection component 100. In other embodiments, however, the ends 22, 23 may be the same or different, and may be rounded, flattened, pointed, or any such geometry which permits the MRDS 200 to slide onto the dovetail connection component 100.

The upper surface 20 includes two screw holes 27 which align and are coaxial with the threaded openings 17 of the firearm 10. In the embodiment shown, the screw holes 27 are countersunk. This allows the dovetail connection component 100 to be secured to the firearm 10 using the firearm's 10 existing structures, and for the screws to be flush or lower than the upper surface 20 so as to not affect the sliding of the MRDS 200 onto the dovetail connection component 100.

Figure 3:
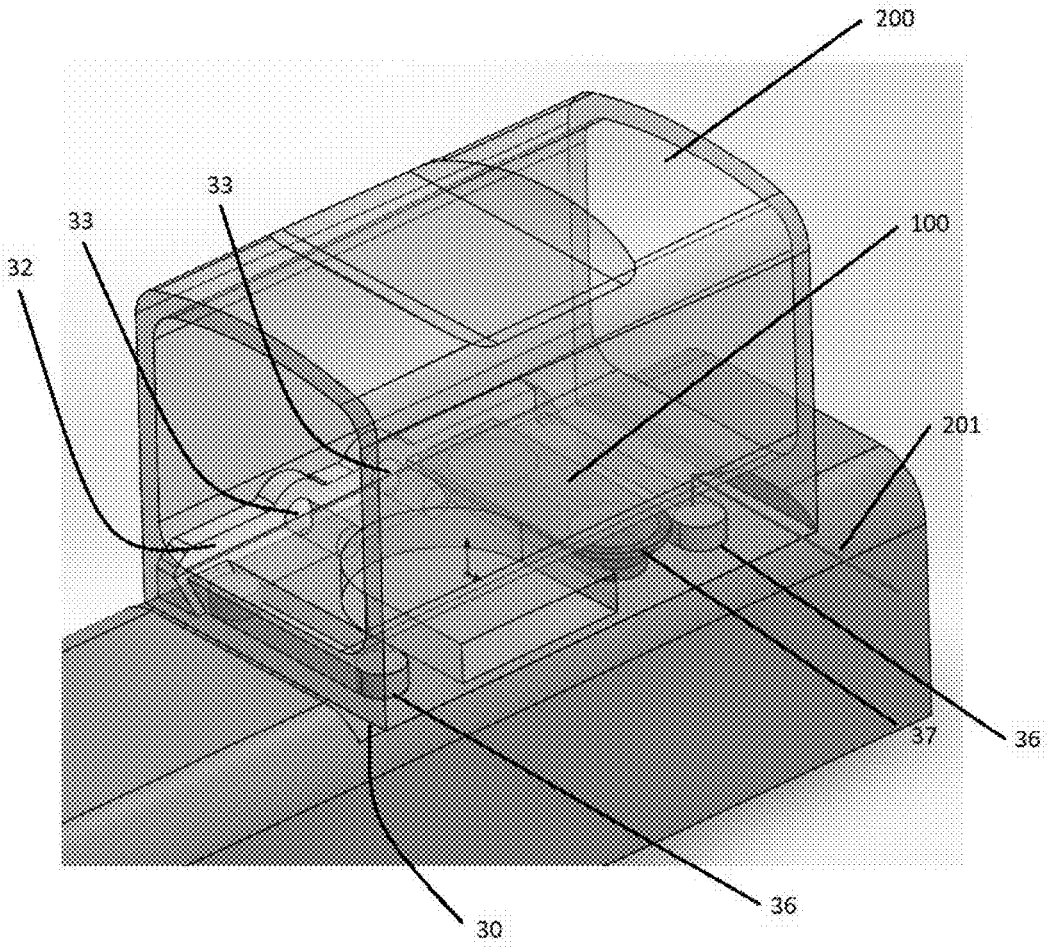
FIG. 3 illustrates a closed MRDS secured to a firearm using the dovetail connection component of FIG. 2, in accordance with embodiments of the present disclosure.

FIG. 3 illustrates a closed MRDS 200 secured to a firearm using the dovetail connection component 100. The bottom surface 30 of the closed MRDS 200 includes a number of channels which allow the MRDS 200 to slidingly connect with the dovetail connection component 100 and also be compatible with the accessory mounting structures 15 of the firearm 10. In particular, the bottom surface 30 includes mortise slot 37 which has a contour corresponding to that of the dovetail connection component 100. Additional channels 36 allow for the MRDS 200 to be slid over the protuberances 16.

The mortise slot 37 and channels 36 are open on a first end to allow the MRDS to move in the direction of arrow 201 and closed at a second end to stop further movement in the direction of arrow 201 once the rounded end 22 and/or one of the protuberances 16 of a pair meets with the closed end of the slot 37 or channels 36.

It will be appreciated that the particular arrangement of the channels 36 and slot 37 are specific to the configuration of the accessory mounting structures 15 of this particular firearm 10. The design and configuration of the channels 36 in particular can vary depending on the firearm 10 to which the MRDS will be secured.

The far side (in the orientation shown) MRDS, or the side on which the channels 36 and slot 37 are open, is a fastening area 32. In the embodiment shown, the fastening area is a recessed portion or groove 32 which extends along a length of the side of the MRDS such that each of the channels 36 and slot 37 open to the groove 32. In the embodiment shown, the fastening area 32 further includes a securing structure 33. In an embodiment, the securing structure is at least one screw hole, or in the particular embodiment shown in FIG. 3, two screw holes. In further embodiments, other securing structures may be provided, including contoured recesses, protuberances, snap-fit structures, buttons, tabs, and combinations of these and other structures.

Figure 4:
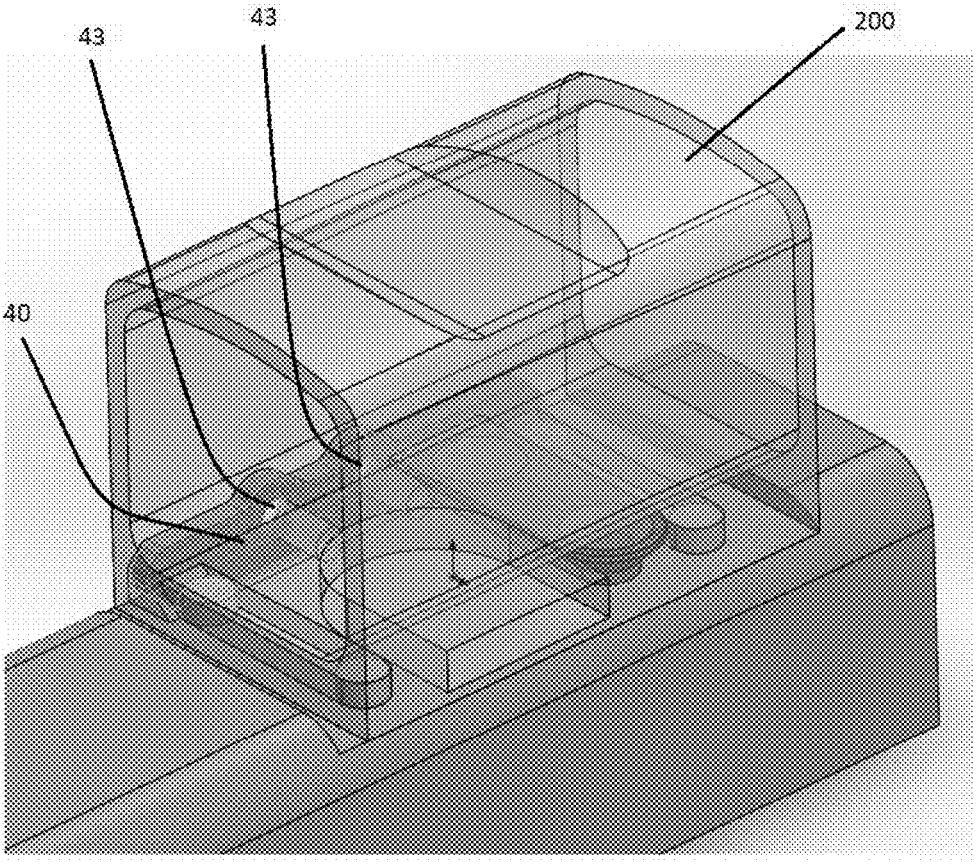
FIG. 4 shows the secured closed MRDS of FIG. 3 with the side cover plate in place, in accordance with embodiments of the present disclosure.

The fastening area 32 is specifically designed to secure a fastening element 40. As shown in FIG. 4, the fastening element 40 has a shape and geometry to fit with and secure to the fastening area 32. That is, in the particular embodiment shown, the fastening element 40 is a plate which has the same general shape as the fastening area 32, but dimensions just less than that of the fastening area 32 in order to permit the fastening element 40 to sit flush with the outside of the MRDS 200 when secured in position. The fastening element 40 has a securing structure 43 which corresponds to the securing structure 33 of the MRDS 200. In the specific embodiment shown, therefore, the securing structure 43 has at least one, or as shown in FIG. 4, two screw holes which align and are coaxial with the screw holes 33 of the fastening area 32. However, in further embodiments, other securing structures may be provided so long as they correspond with the securing structures 33 of the fastening area 32, such as, for example, contoured recesses, protuberances, snap-fit structures, buttons, tabs, and combinations of these and other structures.

Figure 5A:
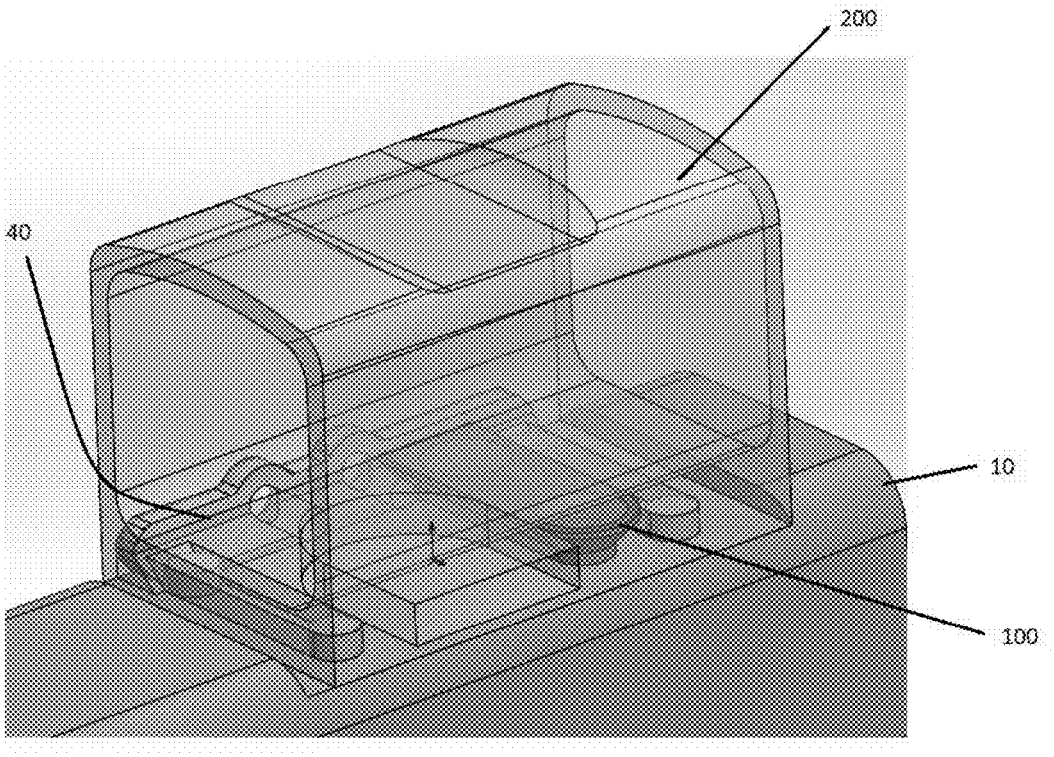
FIGS. 5A and 5B show the left and right sides, respectively, of the fully secured MRDS.
Figure 5B:
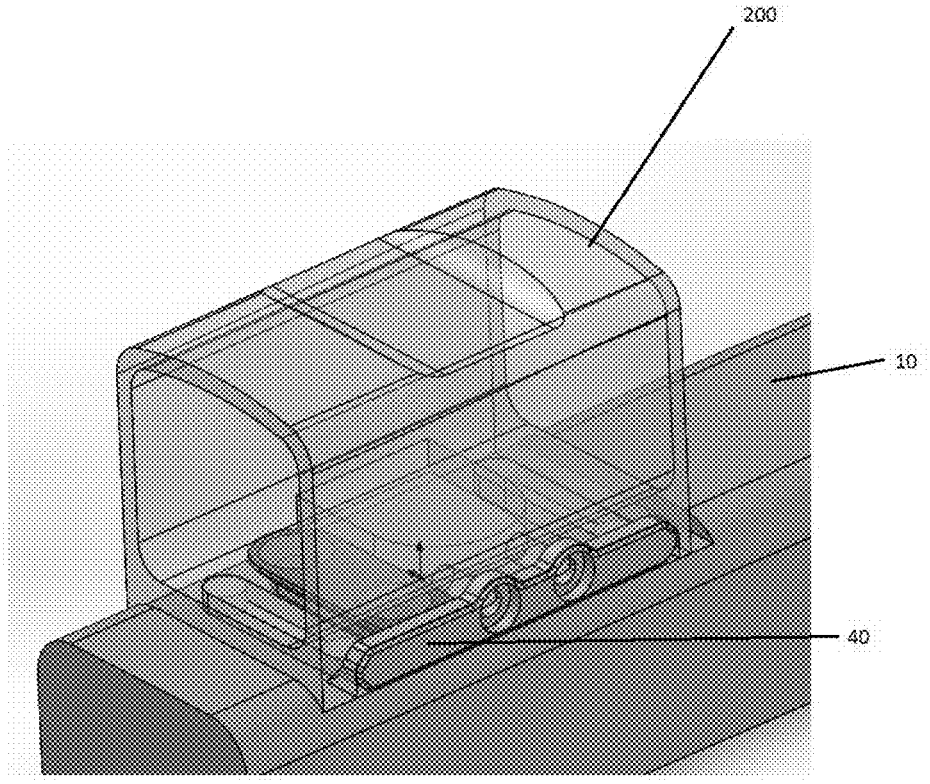

To secure the MRDS 200 in place, the securing structures 33, 43 are aligned and the fastening element secured to the fastening area 32. In the embodiment shown in FIGS. 4-5B, for example, screws are tightened in the holes 33/43 which clamps the side cover plate 40 to the MRDS 200. The MRDS 200 is thus prevented from sliding off the firearm 10, as shown more fully in FIGS. 5A and 5B.

Although the mounting system is described with reference to a MRDS, a wide variety of other viewing optics may be secured to a firearm, and particularly to a small firearm such as a pistol or handgun, using the mounting system described herein. As used herein, the term "viewing optic" refers to an apparatus used by a shooter or a spotter to select, identify or monitor a target. The "viewing optic" may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the "viewing optic" device may be unaltered, or it may be enhanced, for example, by magnification, amplification, subtraction, superimposition, filtration, stabilization, template matching, or other means. The target selected, identified or monitored by the "viewing optic" may be within the line of sight of the shooter, or tangential to the sight of the shooter, or the shooter's line of sight may be obstructed while the target acquisition device presents a focused image of the target to the shooter. The image of the target acquired by the "viewing optic" may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. In one embodiment, the viewing optic is a MRDS, and more particularly a closed MRDS.

While various embodiments of the mounting system have been described in detail, it should be apparent that modifications and variations thereto are possible, all of which fall within the true spirit and scope of the invention. With respect to the above description then, it is to be realized that the optimum dimensional relationships for the parts of the disclosed technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A mounting system for securing a viewing optic to a firearm, the mounting system comprising:

an oblong dovetail connection component having a first end, a second end, and a contoured perimeter forming a dovetail profile;

a viewing optic having a bottom surface comprising a mortise slot open at a first end to receive the oblong dovetail connection component and closed at a second end, the bottom surface further comprising two channels open at a first end and closed at a second end, wherein one of the two channels is to the right of the mortise slot and the other of the two channels is to the left of the mortise slot, the viewing optic further comprising a fastening area on a side of the viewing optic, the fastening area having a first securing structure; and a fastening element having a second securing structure, wherein the first and second securing structures correspond to one another and facilitate securing the fastening element to the fastening area.

2. The mounting system of claim 1, wherein the fastening area is a contoured groove having a depth and the fastening element has a thickness approximately equal to the depth of the contoured groove.

3. The mounting system of claim 1, wherein the first end of the oblong dovetail connection component is rounded.

4. The mounting system of claim 1, where in the first and second securing structures each comprise at least one screw hole, wherein the respective at least one screw holes of the fastening area and the fastening element are coaxial.

5. The mounting system of claim 1, wherein the viewing optic is a mini red dot sight.

6. The mounting system of claim 5, wherein the mini red dot sight is a closed mini red dot sight.

7. A firearm comprising:

at least one accessory mounting structure comprising a pair of threaded openings;

a dovetail connection component having a first end, a second end, a contoured perimeter forming a dovetail profile, and at least two screw holes, wherein the dovetail connection component is positioned on the firearm such that the at least two screw holes are coaxial with the threaded openings and secured to the firearm using at least two screws;

a viewing optic having a bottom surface comprising a mortise slot open at a first end to receive the oblong dovetail connection component and closed at a second end, the bottom surface further comprising two channels open at a first end and closed at a second end, wherein one of the two channels is to the right of the mortise slot and the other of the two channels is to the left of the mortise slot, the viewing optic further comprising a fastening area on a side of the viewing optic, the fastening area having a securing structure, wherein the viewing optic is slidingly engaged with the dovetail connection component; and a fastening element having a second securing structure, wherein the first and second securing structures correspond to one another and facilitate securing the fastening element to the fastening area.

8. The firearm of claim 7, wherein the at least two screw holes of the dovetail connection component are countersunk.

9. The firearm of claim 7, the fastening area is a contoured groove having a depth and the fastening element has a thickness approximately equal to the depth of the contoured groove.

10. The firearm of claim 7, wherein the first end of the oblong dovetail connection component is rounded.

11. The firearm of claim 7, where in the first and second securing structures each comprise at least one screw hole, wherein the respective at least one screw holes of the fastening area and the fastening element are coaxial.

12. The firearm of claim 11, further comprising at least one screw engaging the first and second securing structures.

13. The firearm of claim 7, wherein the firearm is selected from a handgun and a pistol.

14. The firearm of claim 7, wherein the viewing optic is a mini red dot sight.

15. The firearm of claim 14, wherein the mini red dot sight is a closed mini red dot sight.

* * * * *